US008727802B2

(12) United States Patent
Anastas

(10) Patent No.: US 8,727,802 B2
(45) Date of Patent: May 20, 2014

(54) GENERATING A SYNTHETIC TACTILE SENSATION IN A CONNECTOR

(71) Applicant: Apple Inc., Cupertino, CA (US)

(72) Inventor: George V. Anastas, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 50 days.

(21) Appl. No.: 13/625,637

(22) Filed: Sep. 24, 2012

(65) Prior Publication Data

US 2014/0087585 A1 Mar. 27, 2014

(51) Int. Cl.
*H01R 24/00* (2011.01)

(52) U.S. Cl.
USPC ..... 439/489

(58) Field of Classification Search
USPC ..... 439/489
See application file for complete search history.

(56) References Cited

U.S. PATENT DOCUMENTS

| | | | | |
|---|---|---|---|---|
| 5,772,466 | A * | 6/1998 | Morin et al. | 439/489 |
| 6,095,851 | A * | 8/2000 | Laity et al. | 439/490 |
| 6,890,197 | B2 * | 5/2005 | Liebenow | 439/188 |
| 7,314,392 | B2 * | 1/2008 | Pharn et al. | 439/676 |
| 7,828,569 | B2 * | 11/2010 | Aronson et al. | 439/218 |
| 8,376,787 | B2 * | 2/2013 | Panella et al. | 439/676 |
| 8,480,438 | B2 * | 7/2013 | Mattson | 439/676 |

* cited by examiner

*Primary Examiner* — Gary Paumen
(74) *Attorney, Agent, or Firm* — Park, Vaughan, Fleming & Dowler LLP; A. Richard Park

(57) ABSTRACT

A method and apparatus are described for generating a synthetic tactile sensation in a connector in an electronic device. In the described embodiments, a sensor is coupled to a receptacle for the connector and configured to sense a mating of the receptacle and a plug for the connector. An actuator is coupled to the receptacle, and a processing subsystem is coupled to the sensor and the actuator and configured to use the actuator to generate a synthetic tactile sensation based on information received from the sensor.

20 Claims, 2 Drawing Sheets

GENERATING A SYNTHETIC TACTILE SENSATION IN A CONNECTOR

BACKGROUND

1. Field

The described embodiments relate to techniques for generating a tactile sensation in an electronic device. More specifically, the described embodiments relate to techniques for generating a synthetic tactile sensation in a connector in an electronic device.

2. Related Art

The insertion and extraction of a connector plug into and out of a receptacle may often generate a tactile sensation. The tactile sensation may be due to the design of the plug and/or the receptacle and may use friction of the mating parts, springs, or magnets. However, designing a desired tactile sensation for the insertion or extraction of a plug into or out of a receptacle can be difficult due to manufacturing variations, environmental factors, and wear during use.

BRIEF DESCRIPTION OF THE FIGURES

In the figures, like reference numerals refer to the same figure elements.

DETAILED DESCRIPTION

Figure 1:
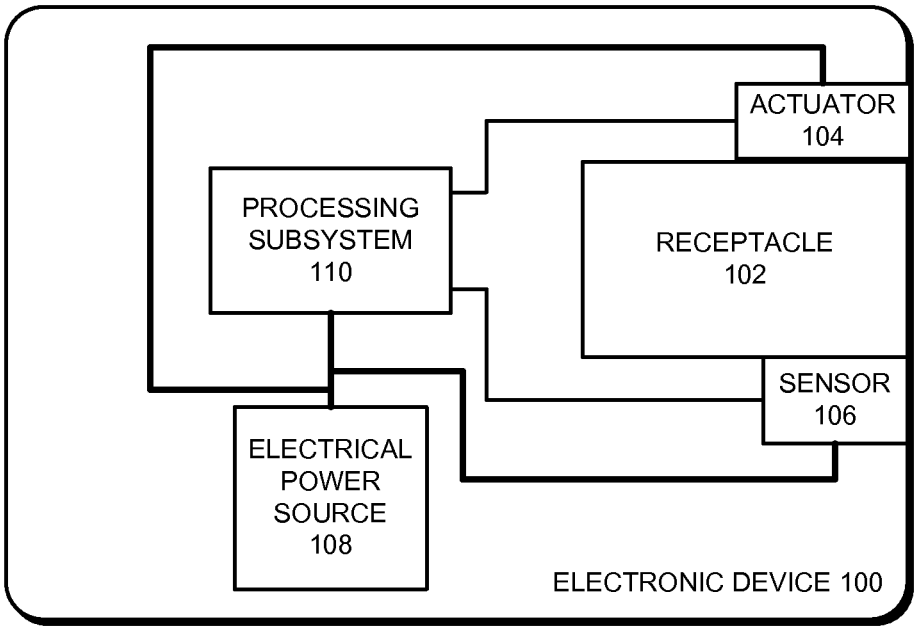
FIG. 1 presents a block diagram illustrating an electronic device in accordance with the described embodiments.

The following description is presented to enable any person skilled in the art to make and use the described embodiments, and is provided in the context of a particular application and its requirements. Various modifications to the described embodiments will be readily apparent to those skilled in the art, and the general principles defined herein may be applied to other embodiments and applications without departing from the spirit and scope of the described embodiments. Thus, the described embodiments are not limited to the embodiments shown, but are to be accorded the widest scope consistent with the principles and features disclosed herein.

The data structures and code described in this detailed description are typically stored on a computer-readable storage medium, which may be any device or medium that can store code and/or data for use by an electronic device and/or processing subsystem with computing capabilities. For example, the computer-readable storage medium can include volatile memory or non-volatile memory, including flash memory, random access memory (RAM, SRAM, DRAM, RDRAM, DDR/DDR2/DDR3 SDRAM, etc.), magnetic or optical storage mediums (e.g., disk drives, magnetic tape, CDs, DVDs), or other mediums capable of storing data structures or code. Note that, in the described embodiments, the computer-readable storage medium does not include non-statutory computer-readable storage mediums such as transmission signals.

The methods and processes described in this detailed description can be included in hardware modules. For example, the hardware modules can include, but are not limited to, one or more application-specific integrated circuit (ASIC) chips, field-programmable gate arrays (FPGAs), other programmable-logic devices, dedicated logic devices, and microcontrollers. When the hardware modules are activated, the hardware modules perform the methods and processes included within the hardware modules. In some embodiments, the hardware modules include one or more general-purpose circuits that are configured by executing instructions (program code, firmware, etc.) to perform the methods and processes.

The methods and processes described in the detailed description section can be embodied as code and/or data that can be stored in a computer-readable storage medium as described above. When a processing subsystem with computing capabilities reads and executes the code and/or data stored on the computer-readable storage medium, the processing subsystem performs the methods and processes embodied as data structures and code and stored within the computer-readable storage medium. For example, in some embodiments, a processor in a processing subsystem can read the code and/or data from a memory in the processing subsystem that comprises a computer-readable storage medium and can execute code and/or use the data to perform the methods and processes.

In the following description, we refer to "some embodiments." Note that "some embodiments" describes a subset of all of the possible embodiments, but does not always specify the same subset of embodiments.

FIG. 1 presents a block diagram illustrating a receptacle in an electronic device in accordance with the described embodiments. Electronic device 100 includes receptacle 102, actuator 104, sensor 106, and electrical power source 108. Electrical power source 108 is coupled to processing subsystem 110, actuator 104 and sensor 106, and processing subsystem 110 is coupled to actuator 104 and sensor 106.

Electronic device 100 can be (or can be included in) any device that includes a receptacle for a connector plug in accordance with embodiments. For example, electronic device 100 can be (or can be included in) a laptop computer, desktop computer, a server, an appliance, a subnotebook/netbook, a tablet computer, a cellular phone, a personal digital assistant (PDA), a smartphone, or another device. Note that electronic device 100 can include other subsystems (not shown) including but not limited to memory subsystems (e.g., volatile and non-volatile), communications subsystems, display subsystems, data collection subsystems, audio and/or video subsystems, alarm subsystems, media processing subsystems, input/output (I/O) subsystems and/or one or more other processing subsystems (e.g., CPUs). Note that one or more of these subsystems may be powered by electrical power source 108 or by another power source, such as an electrical adapter or a battery.

Receptacle 102 may be any receptacle for a connector plug and includes without limitation a universal serial bus (USB) receptacle, an RJ45 receptacle, an HDMI receptacle, an audio cable/microphone receptacle (e.g., for headphone/microphone), an IEEE 1394 receptacle, or any other connector receptacle.

Actuator 104 is any type of actuator powered by an electrical power source that can impart motion of any type to receptacle 102. Actuator 104 may include but is not limited to one or more of the following: a piezoelectric actuator (e.g., resonant mode piezoelectric actuator), a pager vibrator motor, a vibrating actuator, a shaped memory alloy (SMA) actuator, a reaction mass actuator, or any other actuator that can convert electrical power into mechanical motion such as vibration. Actuator 104 is connected to and powered by electrical power source 108 and connected to and controlled by processing subsystem 110. Actuator 104 may include an amplifier to amplify the control signal from processing subsystem 110 to drive one or more subsystems of actuator 104 that produce the mechanical motion. In some embodiments, actuator 104 may also be controlled by processing subsystem to produce a sound, or actuator 104 may include a separate subsystem that can be controlled by processing subsystem 110 to produce a sound. For example, in some embodiments, actuator 104 may include a piezoelectric actuator that can mechanically vibrate receptacle 102 to produce a tactile sensation and also can be controlled to produce a sound. Note that, in some embodiments, processing subsystem 110 may control other subsystems of electronic device 100 to produce a sound (e.g., an audio subsystem of electronic device 100 that includes speakers).

Sensor 106 is any type of sensor that can sense the presence of a connector plug mating with receptacle 102 either while the connector plug is engaging with receptacle 102 or disengaging with receptacle 102. Sensor 106 may sense the mating of a connector with receptacle 102 using any method, including but not limited to detecting force (e.g., while engaging or disengaging the plug from receptacle 102), optical detection (e.g., using light scattered by a plug or the interruption of a beam by the plug), magnetic sensor, magnetic reed switch, electrical continuity (e.g., with plug or receptacle body or sensing a connection of mate first contacts), physical presence of plug (e.g., using a piezoelectric flapper or sensor, or a contact switch), or any other method. Sensor 106 is connected to and powered by electrical power source 108 and is coupled to and transmits sensing information to processing subsystem 110.

Additionally, sensor 106 may be configured to sense a direction of motion of a connector plug in receptacle 102 using an increase or decrease in the detection signal. For example if sensor 106 includes an optical detector or magnetic sensor, the process of engaging and disengaging a connector plug into and out of receptacle 102 may result in a changing detection signal in sensor 106. For instance, if sensor 106 is an optical detector, then engaging a connector plug into receptacle 102 may increase the light scattered by the plug resulting in an increase in the detected scattered light signal as the connector is engaged, while the process of disengaging the connector results in a decrease in the detected scattered light signal as the connector is disengaged.

Additionally, in some embodiment, sensor 106 may be composed of two or more sensing devices positioned to detect different degrees of engagement between a connector plug and receptacle 102. Note that the two or more sensing devices may be the same type of sensor (e.g., contact switches), or may be different types of sensors (e.g., a contact switch and a piezoelectric flapper). The connector plug motion direction can then be detected based on the signals from the two or more sensing devices and their orientation in receptacle 102.

Electrical power source 108 may be any source of electrical power that can power actuator 104, sensor 106 and processing subsystem 110. Electrical power source 108 may include but is not limited to a battery, an electrical adapter or other DC power supply, or a capacitor (e.g., low leakage capacitor). In some embodiments, one or more of actuator 104, sensor 106 and processing subsystem 110 may be powered by other power sources (not shown) in electronic device 100.

Processing subsystem 110 is any processing subsystem that can receive an input from sensor 106 and output a control signal to actuator 104. Processing subsystem 110 may be implemented in any technology and may include any type of hardware module, software, firmware, and/or any other general purpose or special purpose logic. Processing subsystem 110 may include but is not limited to application-specific integrated circuit (ASIC) chips, field-programmable gate arrays (FPGAs), other programmable-logic devices, dedicated logic devices, and microcontrollers. Processing subsystem 110 is discussed in more detail below with respect to FIG. 2.

Figure 2:
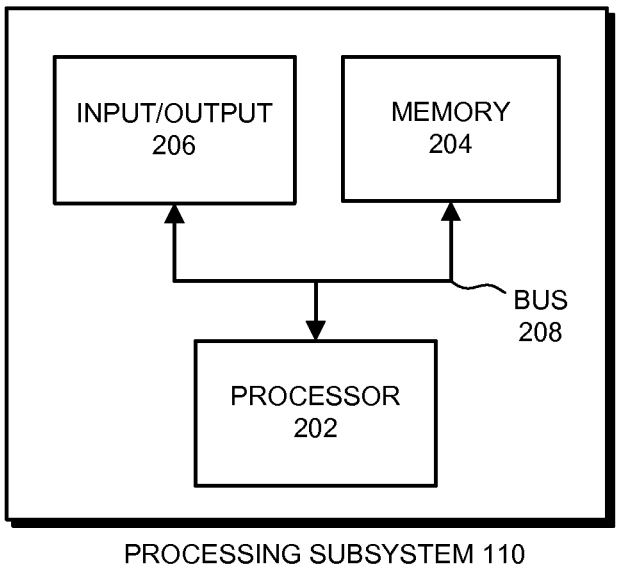
FIG. 2 presents a block diagram illustrating a processing subsystem in accordance with the described embodiments.

FIG. 2 presents a block diagram illustrating a processing subsystem in accordance with the described embodiments. Processing subsystem 110 includes processor 202, memory 204, and I/O 206 all coupled to bus 208.

Processor 202 includes one or more devices configured to perform computational operations. For example, processor 202 can include one or more central processing units (CPUs), microprocessors, application-specific integrated circuits (ASICs), dedicated logic circuits, and/or programmable-logic devices.

Memory 204 includes one or more devices for storing data and/or instructions for processor 202 and input/output (I/O) 206. For example, memory 204 can include dynamic random access memory (DRAM), static random access memory (SRAM), read-only memory (ROM), erasable programmable read-only memory (EPROM), flash memory, and/or other types of memory. In addition, memory 204 can include firmware and mechanisms for controlling access to memory or other subsystems (not shown) in electronic device 100. Furthermore, in some embodiments, memory 204 includes one or more excitation profiles that can be output by processing subsystem 110 to control actuator 104 to generate a synthetic tactile sensation. The excitation profile may include information about the composition of the frequency, amplitude, and duration of the motion generated by actuator 104 to create the synthetic tactile sensation.

I/O 206 includes input and output subsystems for inputting and outputting digital and/or analog signals to and from processing subsystem 110. For example, I/O 206 may include one or more digital and/or analog programmable input and output ports and analog-to-digital input ports. Processor 202 uses I/O 206 to communicate with actuator 104 and sensor 106, and may also allow processing subsystem 110 to communicate with other subsystems (not shown) in electronic device 100 including but not limited to memory subsystems, processing subsystems, audio subsystems, and/or display subsystems.

Processor 202, memory 204, and I/O 206 are coupled together using bus 208. Bus 208 is an electrical, optical, or electro-optical connection that these subsystems can use to communicate commands and data among one another. Although only one bus 208 is shown for clarity, different embodiments can include a different number or configuration of electrical or other connections among the subsystems.

Although processor 202, memory 204 and I/O 206 are shown as separate subsystems in FIG. 2, in some embodiments, some or all of a given subsystem can be integrated into one or more of the other subsystems in processing subsystem 110. Although alternative embodiments can be configured in this way, for clarity we describe the subsystems separately.

Although we use specific subsystems to describe processing subsystem 110, in alternative embodiments, different subsystems may be present in processing subsystem 110. For example, processing subsystem 110 may include one or more additional processors 202, memories 204, and/or I/Os 206. Additionally, one or more of the subsystems may not be present in processing subsystem 110. For example, in some embodiments, processor 202 may be implemented using one or more dedicated logic circuits and separate memory 204 may be omitted. Moreover, in some embodiments, processing subsystem 110 may include one or more additional subsystems that are not shown in FIG. 2.

Those skilled in the art will appreciate that the functionality of processing subsystem 110 may be implemented in multiple ways. For example, processing subsystem 110 may be implemented using one or more hardware modules (e.g., microcontrollers and/or other integrated circuits) in electronic device 100. Similarly, a portion of the functionality of processing subsystem 110 may be implemented in software that executes on a processor of electronic device 100, and/or combinations of in-situ hardware and/or software components in electronic device 100.

The embodiment of FIG. 1 operates as follows. When a plug for a connector is inserted into receptacle 102, sensor 106 senses the mating and sends a signal to processing subsystem 110. Note that, in some embodiments, sensor 106 may be configured to sense engagement between the plug and receptacle 102 at a point in the mating process prior to full engagement. For example, in some embodiments, sensor 106 may be a magnetic sensor, a piezoelectric beam sensor, a simple switch, or an optical sensor that detects the presence of the plug for a connector as the plug is inserted into receptacle 102, but before the plug is operationally engaged in receptacle 102. Additionally, in some embodiments, sensor 106 may also be used to detect when the mating process is reversed.

When processing subsystem 110 receives a signal from sensor 106 indicating that a connector plug is mating (e.g., engaging or disengaging) with receptacle 102, then processing subsystem 110 controls actuator 104 to generate a motion which is transmitted to receptacle 102, creating a synthetic tactile sensation. Actuator 104 may physically contact, be coupled to, strike or otherwise generate motion in receptacle 102 so that when actuator 104 is activated, motion created by actuator 104 is transferred to receptacle 102 to generate the synthetic tactile sensation. In some embodiments, processing subsystem 110 controls actuator 104 to create a motion profile based on the type of receptacle that receptacle 102 is (e.g., a USB plug, an RJ45 plug, or a power adapter) and on information received from sensor 106. The motion profile may include adjusting parameters of the motion, including but not limited to the composition of the frequency, amplitude, and duration of the motion to create the synthetic tactile sensation in receptacle 102. The information received from sensor 106 may include but is not limited to whether the plug is engaging or disengaging from receptacle 102. For example, processing subsystem 110 may control actuator 104 to generate a first motion profile when sensor 106 detects that the connector plug is being engaged into receptacle 102, and a second motion profile when sensor 106 detects that the connector plug is being disengaged from receptacle 102.

Additionally, in some embodiments, processing subsystem 110 may also be coupled to other subsystems in electronic device 100 and may use information from these subsystems in addition to information from sensor 106 to determine the motion profile used to generate the synthetic tactile sensation. The information received by processing subsystem 110 from other subsystems in electronic device 100 may include but is not limited to one or more of: the configuration of applications or processes running on electronic device 100, the power usage of electronic device 100, the state of charge of a battery in electronic device 100, other connectors plugged into electronic device 100 (e.g., data, peripheral and/or electrical power connectors), and/or if the plug is correctly inserted into receptacle 102. For example, if electronic device 100 is downloading data through a connector (e.g., Ethernet cable) plugged into receptacle 102, a predetermined synthetic tactile sensation may be generated if the connector is unplugged during the downloading process to alert a user. Furthermore, if receptacle 102 is a receptacle for a power adapter and processing subsystem 110 detects that electronic device 100 is being powered by a battery with a state of charge below a predetermined limit, then another predetermined tactile sensation may be generated when an adapter is plugged into receptacle 102.

Additionally, processing subsystem 110 may control actuator 104 and/or a subsystem of electronic device 100 to produce a sound in addition to the synthetic tactile sensation. In some embodiments, the sound may be produced by actuator 104, and in some embodiments, the sound may be produced in other subsystems of electronic device 100 (e.g., an audio subsystem, not shown).

Figure 3:
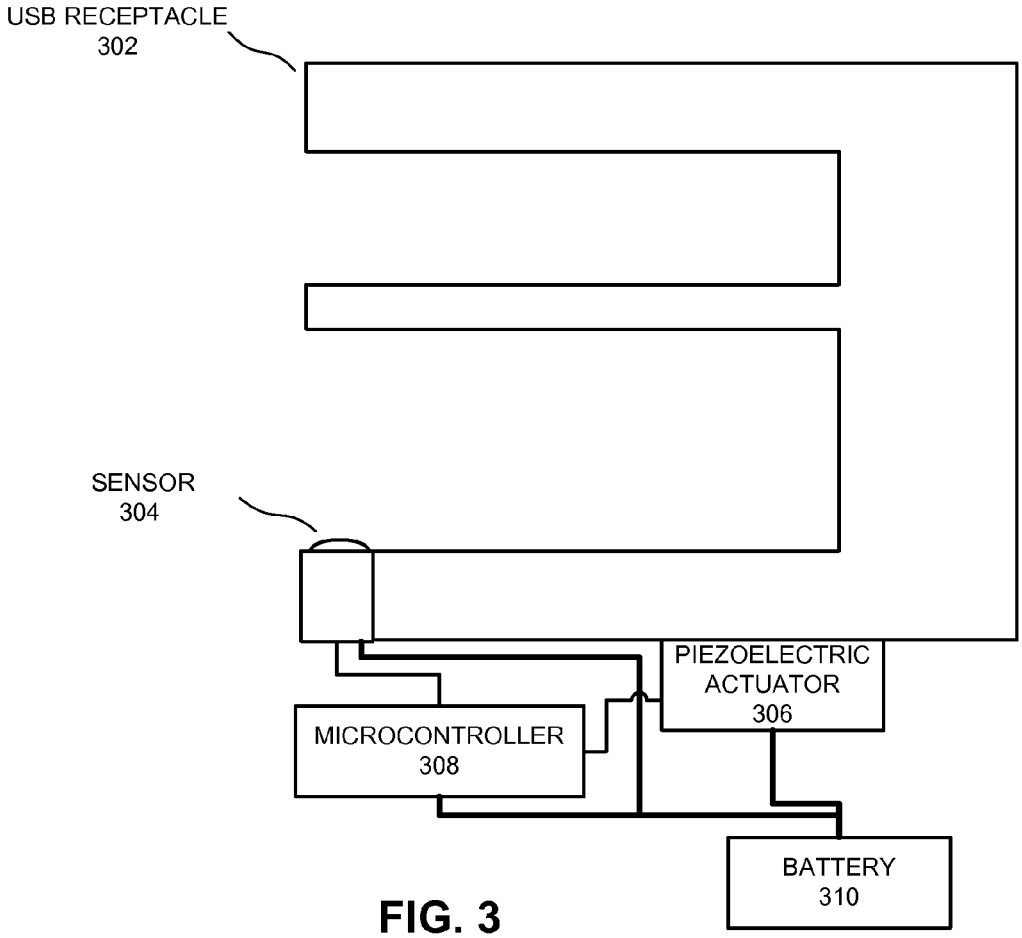
FIG. 3 presents a block diagram illustrating a universal serial bus receptacle in accordance with the described embodiments.

FIG. 3 presents a block diagram illustrating a USB receptacle in accordance with described embodiments. FIG. 3 includes USB receptacle 302, sensor 304 and piezoelectric actuator 306, each coupled to microcontroller 308 and battery 310.

USB receptacle 302 can be any receptacle for a USB connector plug and may be in any type of electronic device, such as electronic device 100. Sensor 304 is a sensor with a rounded protrusion that intrudes into the opening of USB receptacle 302. When a USB connector plug is inserted into USB receptacle 302, the protrusion is pushed and sensor 304 is activated. Sensor 304 may be any type of mechanical or electromechanical switch. For example, sensor 304 could be a contact switch or a piezoelectric cantilevered protrusion.

Piezoelectric actuator 306 is a resonant mode piezoelectric actuator that is powered by battery 310 and in contact with USB receptacle 302, so that when piezoelectric actuator 306 is activated, it vibrates USB receptacle 302. Microcontroller 308 is a microcontroller programmed so that, when sensor 304 is activated, microcontroller 308 activates piezoelectric actuator 306. Microcontroller 308 may include programming to generate a predetermined synthetic tactile sensation in USB receptacle 302 using one or more predetermined compositions of frequency, amplitude, and duration to control piezoelectric actuator 306. Additionally, in some embodiments, microcontroller 308 may control piezoelectric actuator 306 to produce a predetermined sound in addition to a predetermined synthetic tactile sensation.

Battery 310 can be any battery in the electronic device. In some embodiments, electrical power from battery 310 is sent through a power management unit in the electronic device that may regulate and/or convert the electrical power from battery 310 to one or more other voltages which are then used to operate sensor 304, piezoelectric actuator 306 and microcontroller 308.

Alternative Embodiments

Although the above-described embodiments include only one each of actuator 104, sensor 106 and processing subsystem 110, some embodiments may include more than one of each of these mechanisms. For example, in some embodiments, more than one sensor may be used to sense a connector plug mating with receptacle 102, or more than one actuator may be used to generate the synthetic tactile sensation. Additionally, in some embodiments, some or all of the above-described functions can be implemented in one integrated mechanism. For example, a sensor may include an integrated processing subsystem that is coupled to a separate actuator.

The foregoing descriptions of embodiments have been presented only for purposes of illustration and description. They are not intended to be exhaustive or to limit the embodiments to the forms disclosed. Accordingly, many modifications and variations will be apparent to practitioners skilled in the art.

Additionally, the above disclosure is not intended to limit the embodiments. The scope of the embodiments is defined by the appended claims.

What is claimed is:

1. A system that generates a synthetic tactile sensation in a connector in an electronic device, comprising:

a sensor coupled to a receptacle for the connector and configured to sense a mating of the receptacle and a plug for the connector;

an actuator coupled to the receptacle; and a processing subsystem coupled to the sensor and the actuator and configured to use the actuator to generate a synthetic tactile sensation based on information received from the sensor.

2. The system of claim 1, wherein the sensor is configured to sense the mating of the plug and the receptacle before the plug is operatively connected to the receptacle.

3. The system of claim 1, wherein the mating the sensor is configured to sense includes an engagement of the plug and the receptacle and a disengagement of the plug and the receptacle.

4. The system of claim 1, wherein the actuator is a piezoelectric actuator.

5. The system of claim 1, wherein the processing subsystem is further configured to control a generation of a sound based on the information received from the sensor.

6. The system of claim 5, wherein the processing subsystem is configured to control the generation of the sound by a piezoelectric actuator contemporaneously with the generation of the synthetic tactile sensation.

7. The system of claim 1, wherein the connector includes a universal serial bus connector.

8. A method for generating a synthetic tactile sensation in a connector in an electronic device, comprising:

sensing a mating between a plug on the connector and a receptacle for the connector; and generating the synthetic tactile sensation based on the sensed mating.

9. The method of claim 8, wherein generating the synthetic tactile sensation includes generating the synthetic tactile sensation in the connector.

10. The method of claim 8, wherein sensing the mating between the plug and the connector includes sensing the mating before the plug is operatively connected to the receptacle.

11. The method of claim 8, wherein sensing the mating between the plug and the connector includes sensing an engagement of the plug and the receptacle and a disengagement of the plug and the receptacle.

12. The method of claim 8, further including generating a sound based on the sensed mating.

13. The method of claim 12, wherein the sound is generated contemporaneously with the synthetic tactile sensation.

14. A system that generates a motion of a connector in an electronic device, comprising:

a sensor coupled to a receptacle for the connector and configured to sense a relative position of the receptacle and a plug for the connector;

an actuator coupled to the receptacle; and a processing subsystem coupled to the sensor and the actuator, and configured to use the actuator to generate the motion based on information received from the sensor.

15. The system of claim 14, wherein the sensor is configured to sense the relative position of the plug and the receptacle before the plug is operatively connected to the receptacle.

16. The system of claim 14, wherein the sensor is configured to sense an engagement motion of the plug and the receptacle and a disengagement motion of the plug and the receptacle.

17. The system of claim 14, wherein the processing subsystem is further configured to use the actuator to generate the motion based on a connector type of the connector.

18. The system of claim 14, wherein the processing subsystem is further configured to control a generation of a sound based on the information received from the sensor.

19. The system of claim 18, wherein the processing subsystem is configured to control the generation of the sound contemporaneously with the generation of the motion.

20. The system of claim 14, wherein the actuator is a piezoelectric actuator.

* * * * *